US010529257B1

(12) United States Patent
Peelgrane

(10) Patent No.: US 10,529,257 B1
(45) Date of Patent: Jan. 7, 2020

(54) MARKING PANEL

(71) Applicant: RE FACTOR TACTICAL, LLC., Englewood, CO (US)

(72) Inventor: Luke Quinn Peelgrane, Englewood, CO (US)

(73) Assignee: RE FACTOR TACTICAL, LLC., Englewood, CO (US)

( * ) Notice: Subject to any disclaimer, the term of this patent is extended or adjusted under 35 U.S.C. 154(b) by 0 days.

(21) Appl. No.: 16/102,447

(22) Filed: Aug. 13, 2018

(51) Int. Cl.

| | |
|---|---|
| ***G09F 3/14*** | (2006.01) |
| ***G09F 13/16*** | (2006.01) |
| ***G09F 7/18*** | (2006.01) |
| ***G09F 3/02*** | (2006.01) |
| *G09F 7/00* | (2006.01) |

(52) U.S. Cl.
CPC ..... *G09F 3/14* (2013.01); *G09F 3/02* (2013.01); *G09F 7/18* (2013.01); *G09F 13/16* (2013.01); *G09F 7/002* (2013.01); *G09F 2003/0276* (2013.01); *G09F 2007/1852* (2013.01); *G09F 2007/1865* (2013.01)

(58) Field of Classification Search
CPC ..... G09F 3/14; G09F 3/02; G09F 7/18; G09F 13/16; G09F 2003/0276; G09F 2007/1852; G09F 2007/1865
See application file for complete search history.

(56) References Cited

U.S. PATENT DOCUMENTS

| | | | | |
|---|---|---|---|---|
| 3,461,584 | A * | 8/1969 | Wilson | G09F 21/04 40/591 |
| 4,906,503 | A * | 3/1990 | De La Cruz | G09F 7/18 116/173 |
| 4,937,962 | A * | 7/1990 | Hornblad | G09F 7/00 40/604 |
| 5,319,870 | A * | 6/1994 | Weiss | G09F 7/18 160/329 |
| 5,337,907 | A * | 8/1994 | McKenzie | A45F 3/00 206/427 |
| 5,522,165 | A * | 6/1996 | Molla | G09F 17/00 40/604 |
| 6,216,374 | B1 * | 4/2001 | Lawrence | G09F 3/20 40/604 |
| 7,117,619 | B1 * | 10/2006 | Huber | A63B 71/0672 40/495 |
| 10,258,852 | B1 * | 4/2019 | Walker | A63B 69/00 |
| 2013/0269229 | A1 * | 10/2013 | Rodriguez-Aparicio, Sr. | G09F 7/18 40/600 |

* cited by examiner

*Primary Examiner* — Gary C Hoge
(74) *Attorney, Agent, or Firm* — Workman Nydegger

(57) ABSTRACT

Marking panels for the identification of field personnel can include (i) a first side, (ii) a second side transverse to the first side and intersecting the first side at a junction, (iii) a front surface at least partially defined by the first and second sides and which includes an insignia, (iv) a rear surface opposite the front surface and at least partially defined by the first and second sides and which includes an optical enhancer attachment site, and (v) a first multi-modal anchoring mechanism disposed proximate the junction of the first and second sides. The first multi-modal anchoring mechanism can include a pocket; a fixed loop, and a selectively attachable loop. The pocket can contain a magnet for selectively affixing the marking panel to a ferromagnetic object.

20 Claims, 9 Drawing Sheets

MARKING PANEL

BACKGROUND

Technical Field

This disclosure generally relates to apparatuses for identifying field personnel. More specifically, the present disclosure relates to selectively affixable marking panels for use in quickly and effectively identifying field personnel.

Related Technology

Without precise telemetry data, it can be difficult to identify the location of an individual in a rural, or even an urban, environment. This is particularly so when attempting to identify the location of ground personnel from an aerial position, such as from an aircraft. If the ground personnel are in constant communication with aerial crewmembers, it can be possible, though cumbersome and time consuming, to identify and track the ground personnel from the air. Various visual cues or signals have been implemented to aid in the identification and tracking of ground personnel. For example, a signal flare can be a useful homing beacon for aerial support to triangulate the personnel's position and are particularly useful in low-light situations. However, signal flares are consumable visual markers that last for a short period of time, and consequently, the use of signal flares needs to be timed properly to have the desired effect. If ground personnel choose to use a signal flare as a visual marker, a balance must be struck between the added weight of carrying a greater number of signal flares and the security of having a sufficient number of signal flares to successfully identify and/or track their position. Also, while signal flares can beneficially mark the personnel's position for friendlies, they can also attract the attention of enemy combatants who can see the same visual cue without the need of any special equipment. This could unintentionally endanger the ground personnel or redirect enemy forces and complicate extraction.

Other visual markers, such as colored smoke, suffer from the same or similar drawbacks as signal flares. Instead, some military branches include a brightly colored patch of material in standard issue survival kits that is intended to be used as a visual marker. The brightly colored patch has two parachute cords affixed to opposing corners of the marker and is touted as being versatile because the parachute cords can be used to tie the marker to many structures. However, the cords are often ineffective and inconvenient. Two hands are required to tie the cords to a structure, and it can take a relatively long period of time and focused effort to affix the marker. In perilous circumstances, such as a firefight or extraction from enemy territory using a high mobility multipurpose wheeled vehicle, the time and effort required to tie the marker can endanger ground personnel. If foregone, aerial (or other) support can be difficult to safely enlist, as it may be difficult to differentiate friend from foe, which increases the risk of collateral damage to friendly elements.

Further complicating the issue, it is often difficult to know when or under what circumstance a visual marker will be needed. In some instances, ground personnel are lost or in need of assistance, and a long-term emergency visual marker is desirable. In other instances, an extraction point is predefined, and a visual cue (e.g., colored smoke) can be used to signal nearby a nearby helicopter. In yet other instances, ground personnel are in a vehicle that needs to be identified or otherwise marked to assist aerial support. Without knowledge of the general location or timing of aerial surveillance or the situation that will benefit from the use of a visual marker, it can be difficult to properly prepare. While it is possible to carry multiple different types of visual makers to account for possible situations, doing so can reduce the mobility and/or unnecessarily overburden the carrier.

Accordingly, there are a number of disadvantages with apparatuses for identifying field personnel that can be addressed.

BRIEF SUMMARY

Implementations of the present disclosure solve one or more of the foregoing or other problems in the art with marking panels. In particular, one or more embodiments of the present disclosure include marking panels that can be quickly adhered to a variety of surfaces and objects to effectively identify field personnel regardless of the level of light.

An exemplary marking panel includes (i) a first side, (ii) a second side transverse to the first side and intersecting the first side at a junction, (iii) a front surface at least partially defined by the first and second sides and which includes an insignia, (iv) a rear surface opposite the front surface and at least partially defined by the first and second sides and which includes an optical enhancer attachment site, and (v) a first multi-modal anchoring mechanism disposed proximate the junction of the first and second sides. The first multi-modal anchoring mechanism can include a pocket; a fixed loop, and a selectively attachable loop. In some embodiments, the pocket can contain a magnet for selectively affixing the marking panel to a ferromagnetic object.

Embodiments of the present disclosure can also include a marking panel having (i) at least two corners with each corner being defined by transverse sides of the marking panel, (ii) a front surface at least partially defined by the at least two corners and which includes an insignia, (iii) a rear surface opposite the front surface and at least partially defined by the at least two corners, (iv) at least two pockets with each pocket being defined by the front and rear surfaces and at least partially bounded by a corner of the at least two corners, and (v) at least two multi-modal anchoring mechanisms that are each disposed at least partially within a separate pocket of the at least two pockets. Each of the at least two multi-modal anchoring mechanisms can include a magnet disposed within the separate pocket, a fixed loop spanning the corner, a fixed portion coupled to the separate pocket and having an attachment mechanism, and an elastic loop selectively coupled to the attachment mechanism of the fixed portion via a complementary attachment mechanism.

Embodiments of the present disclosure can also include a system for identifying field personnel that includes a marking panel and a stuff sack sized and shaped to receive and secure the marking panel in a compact form. The marking panel can include (i) a first sheet of material comprising an insignia, (ii) a second sheet of material coupled to the first sheet of material such that the first sheet comprises a front surface of the marking panel and the second sheet comprises a rear surface of the marking panel and has an optical enhancer attachment site, (iii) at least four pockets formed between the first and second sheets with each pocket being formed at a corresponding corner of the marking panel and having a multi-modal anchoring mechanism associated therewith. Each multi-modal anchoring mechanism can include a rare-earth magnet disposed within each pocket, a fixed loop spanning the corresponding corner, a fixed portion coupled to each pocket and associated with an attachment mechanism, and an elastic loop selectively coupled to the attachment mechanism of the fixed portion via a complementary attachment mechanism.

In at least one embodiment, the marking panel is configured to attach to a vehicle via the rare-earth magnets and remain attached to the vehicle in response to a wind force of at least 50 mph.

In at least one embodiment, the attachment mechanism includes one or more of a quick-release buckle, a carabiner and a corresponding anchor, or a spring snap hook and a corresponding ring.

In at least one embodiment, the optical enhancer attachment site comprises one portion of a hook and loop fastening system. The complementary portion of the hook and loop fastening system can be associated with an infrared reflective patch configured to selectively associate with the optical enhancer attachment site.

Accordingly, marking panels and systems for identifying field personnel are disclosed.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Figure 1:
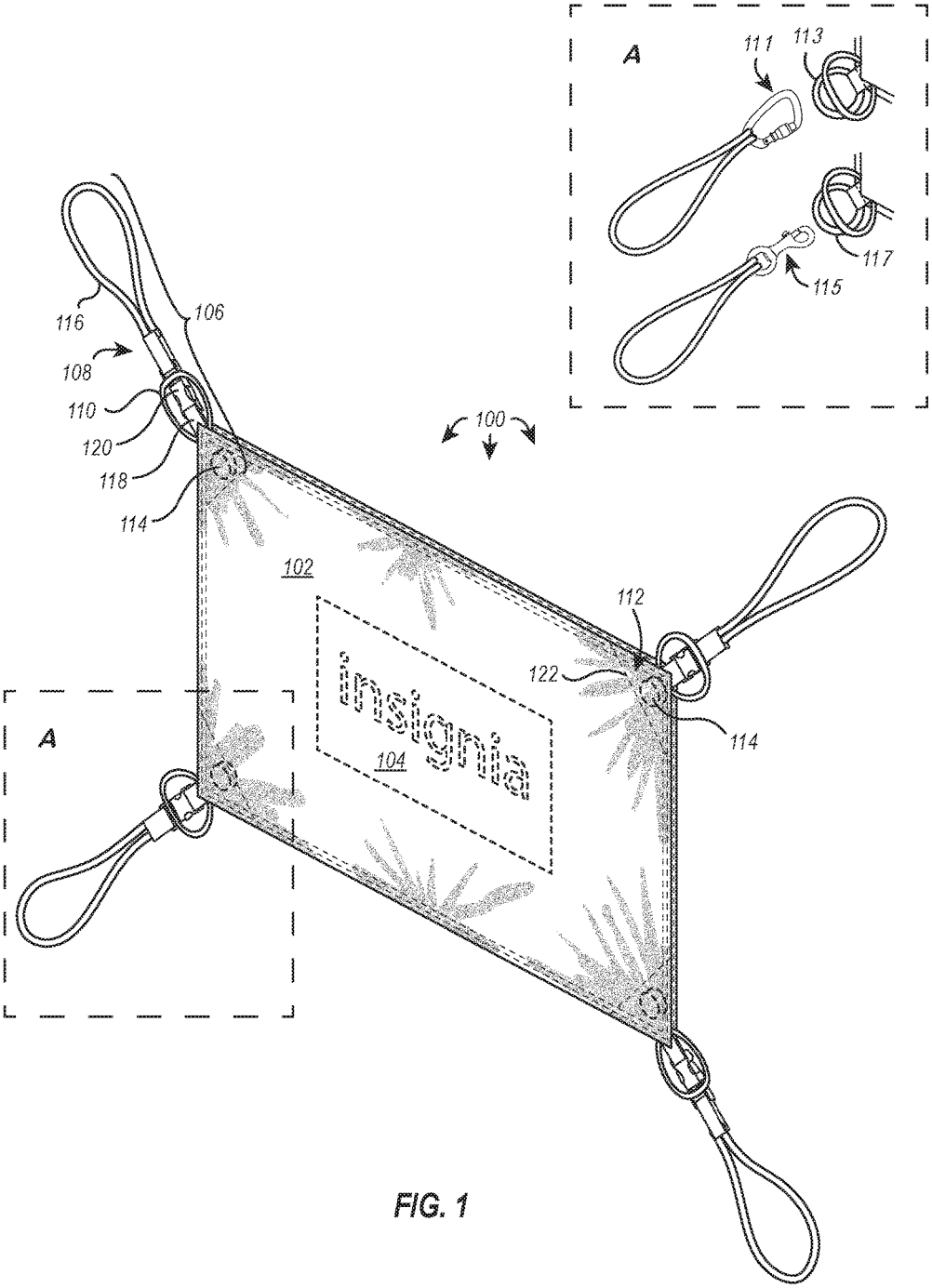
FIG. 1 illustrates a perspective view of an exemplary marking panel in accordance with embodiments of the present disclosure.
Figure 2:
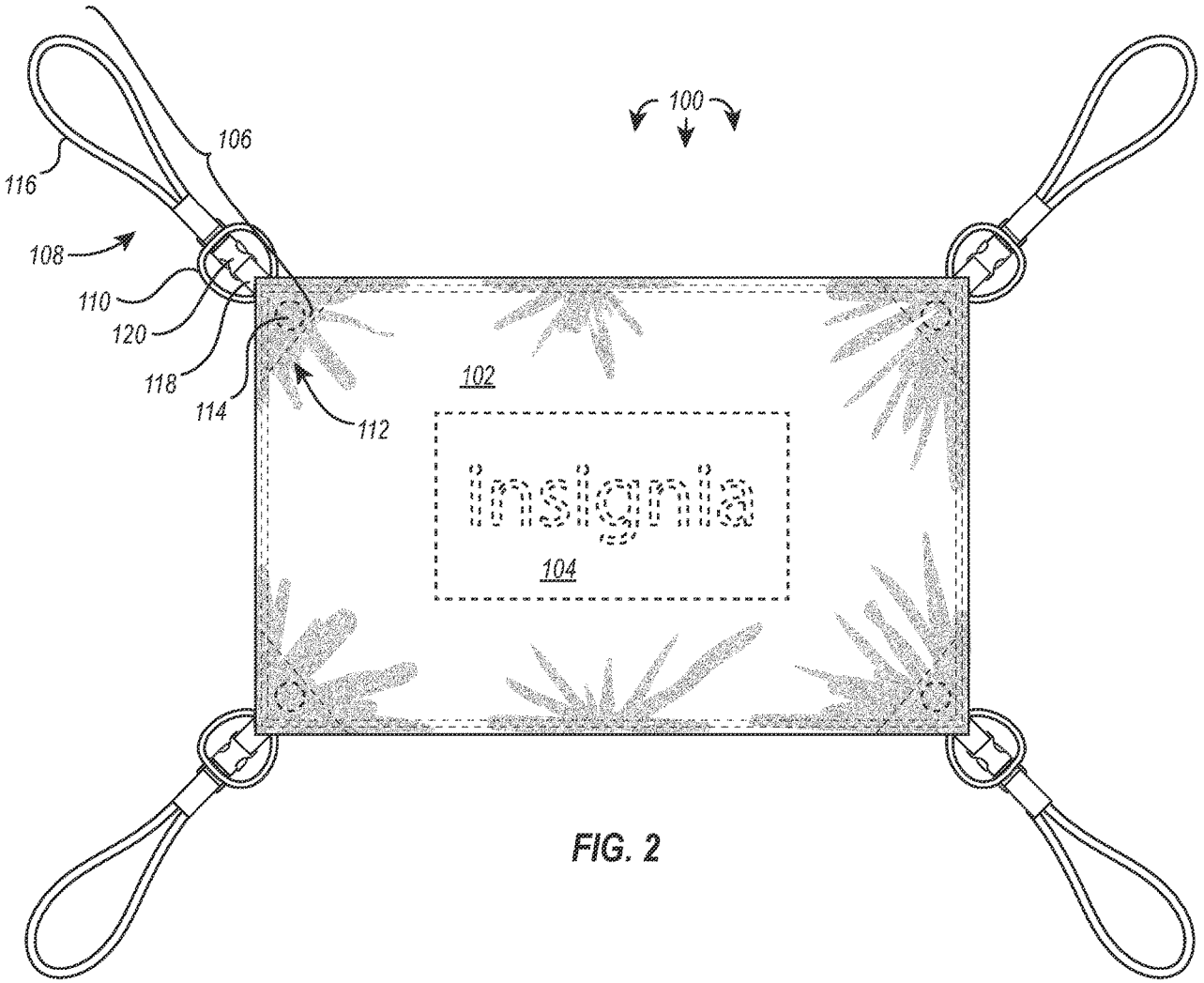
FIG. 2 illustrates a front elevation view of the marking panel of FIG. 1.

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments and is not necessarily intended to limit the scope of the claimed invention.

Overview of Marking Panels

As provided above, there are a number of disadvantages associated with apparatuses for identifying field personnel. In particular, there are a number of disadvantages associated with portable marking panels. For example, previous marking panels consist of a brightly-colored rectangular fabric with a pair of parachute cords positioned at corners thereof. The parachute cords are typically sewn directly to the fabric or affixed to a corner grommet and are used as tie downs to attach the marking panel to an environmental structure (e.g., to identify where help is needed), troop equipment like a rucksack (e.g., to identify friendly troops), or vehicles (e.g., to identify the vehicle from the air and ward off friendly fire). However, the tie downs are cumbersome and can take dedicated time and effort to properly and securely tie to the desired structure. In the same respect, removing the currently available marking panels from a structure takes focused time and effort and essentially eliminates the possibility of hastily removing the marking panel. These problems limit the utility of currently available marking panels and the types of situations where such marking panels can be used.

Additionally, the currently available marking panels fail to readily communicate any additional information to the viewer besides location. For example, an aerial support vehicle may be able to identify the location of the marking panel from above, but without extraneous communications, there is no additional verification or indication that the marking panel is associated with a friendly. An enemy combatant could be surreptitiously using the marking panel to incite confusion or in an attempt to avoid being targeted by the aerial support vehicle. This is, among other things, one additional problem with previously available marking panels.

As described in greater detail below, the marking panels of the present disclosure solve one or more of the foregoing or additional problems in the art of apparatuses for identifying the location of personnel, particularly with respect to marking panels. For example, marking panels disclosed herein include multi-modal attachment mechanisms that significantly increase the speed by which marking panels can be associated with various structures and additionally broaden the number and type of ways in which the marking panel can be temporarily affixed to—or otherwise associated with—a structure. In some instances, the multi-modal attachment mechanism includes a quick-release buckle attached to an elastic loop, which can be quickly lassoed around an object or affixed using, for example, a lark's head knot. This decreases the time and effort of attaching a marking panel, which increases the safety of ground personnel and their ability to hastily attach and detach the marking panel from a structure.

The multi-modal attachment mechanisms disclosed herein can additionally include magnets that are configured to selectively attach the marking panel to a ferromagnetic material such as the body of a vehicle. The magnets are of sufficient strength that the marking panel remains attached to the moving vehicle. Accordingly, the user can secure the marking panel to the side or roof of a vehicle quickly to allow ground or aerial identification, respectively, and without the need of tie down anchors, drastically improving the marking panel's utility in the field.

High-visibility surfaces can be provided with the disclosed marking panels to enable identification in lighted conditions. Additionally, the disclosed marking panels can include optical enhancer attachment sites that can be used to selectively attach an optical enhancing element, such as an infrared reflective patch, for low-light or no light conditions. In this way, the marking panels disclosed herein provide a single lightweight, compact device that enables perpetual daylight and nighttime visibility, overcoming the previous problems of consumable visual markers like signal flares. Moreover, the disclosed marking panels are highly adaptable and can be implemented in a myriad of situations, thereby reducing or eliminating the problem of preparing the proper visual marker ahead of time when it is unclear when or under what circumstance a visual marker will be needed.

Marking panels disclosed herein can provide the added benefit of communicating additional information to the viewer by incorporating an insignia onto one of the high-visibility surfaces. This allows support crews (and/or others) to initially locate and then identify, for example, an affiliation, nationality, or other informative detail related to the ground personnel, which can beneficially enable verification or validation of the marking panel and/or ground personnel associated therewith.

Taken together, the features of marking panels disclosed herein provide distinct improvements and added utility over previous marking panels and visual indicators.

Exemplary Marking Panels

Referring now to FIGS. 1-7, illustrated are different views of the same marking panel 100 incorporating at least some of the features and improvements described above. For ease of discussion, the components of the marking panel 100 illustrated in FIGS. 1-7 will be discussed primarily with respect to FIG. 1, though other views will be discussed as necessary.

The marking panel 100 includes a front surface 102, which in some embodiments is a high-visibility color that allows for identification of the marking panel 100 in daylight, or otherwise lighted, environments. The term "high-visibility color," as used herein, is intended to be understood as those colors that are clearly visible and which stand out from environmental colors in broad daylight. High-visibility colors can include fluorescent colors like red, lime green, and orange. As a more particular example, high-visibility colors can include the colors blaze orange, chartreuse green, chartreuse yellow, high-visibility pink, and other colors deemed high-visibility colors by the American National Standards Institute. It should be appreciated that any high-visibility tint of the foregoing exemplary high-visibility colors is included within the definition of "high-visibility color," as used herein.

Also shown in the marking panel 100, the front surface 102 can include an insignia 104. As depicted, the insignia 104 can be centrally located on the front surface 102 and can take up approximately 25% of the surface area of the front surface 102. In some embodiments, the insignia can take up a greater amount of surface area, such as at least 33% or 50% of the surface area. In embodiments where the front surface 102 is a high-visibility color, it should be appreciated that as the surface area taken up by the insignia increases, there is a concomitant decrease in the surface area of the high-visibility color, which can negatively impact the ability to easily and/or quickly identify the marking panel. Accordingly, in some embodiments, the insignia takes up no more than 50% of the front surface.

In some embodiments, the insignia 102 is an indication of national origin, such as a flag, or a symbol adopted by a group of people (e.g., a tribal mark, corp. logo, United Nations Emblem). Additionally, or alternatively, the insignia 102 can be any unique symbol or pattern that can be used to verify ground personnel as friendly and prevent or foil attempted copycats. The insignia 102 can be screen printed, painted, or applied by any other suitable method known in the art.

The marking panel 100 additionally includes a plurality of multi-modal attachment mechanisms 106 secured at corners of the marking panel 100. Each of the multi-modal attachment mechanisms 106 shown in FIG. 1 include a selectively detachable portion 108, a fixed loop 110, and a pocket 112 housing a magnet 114. The selectively detachable portion 108 includes an elastic loop 116 and a fixed portion 118 that are releasably coupled together by an attachment mechanism 120. The attachment mechanism 120 is illustrated as a quick-release buckle in marking panel 100 of FIG. 1, but it should be appreciated that the attachment mechanism 120 can be any attachment mechanism, preferably a quick-release attachment mechanism such as a carabiner 11 and a corresponding anchor 113 or a spring snap hook 115 and a corresponding ring 117 (e.g., as shown by the various attachment mechanism illustrated in box A of FIG. 1). In operation, the elastic loop 116 can be single-handedly detached from the marking panel 100 and secured to a structure (e.g., by wrapping around the structure, using a Lark's Head knot) and brought back into association with the fixed portion 118 quickly and easily. In some embodiments, the elastic loop 116 is made of an elastic cord like a bungee cord. Alternatively, the loop is not elastic and is made of, for example, paracord or a twisted or braided rope.

In some embodiments, the detachable portion 108 is used to connect multiple marking panels 100. This can be done, for example, by detaching the elastic loop 116 and forming a Lark's Head knot with the elastic loop 116 around the fixed loop 110. The attachment mechanism associated with the elastic loop 116 can be associated with a complementary attachment mechanism located on a fixed portion of a second marking panel (not shown). This can be repeated with other pairs of detachable portions and fixed loops to further connect the same marking panels or to connect additional marking panels.

The fixed loop 110 can have additional functionalities. For example, the fixed loop 110 can be used as a secondary attachment site for the marking panel 100. In this manner, the fixed loop 110 can be used to reinforce a connection to a structure as a supplement to the detachable portion 108 and/or the magnet 114, or in the event the detachable portion 108 is damaged or lost, the fixed loop 110 can be used as a backup attachment site. In some embodiments, the fixed loop 110 is made of an elastic material similar to the elastic loop 116, or alternatively, it can be made of a non-elastic material such as paracord or a twisted or braided rope.

As shown in FIGS. 1-7, the fixed loop 110 and the fixed portion 118 of the multi-modal attachment mechanism 106 are secured to the marking panel 100 at a corner or pocket 112. These components can be sewn between two sheets that at least partially define the pocket 112 or can be riveted or otherwise directly coupled to the marking panel 100, as known in the art. The pocket 112 can additionally include a magnet 114, preferably a rare-earth magnet 114. The magnet 114 can be retained at a peripheral edge or corner of the marking panel 100 by a sealing edge 122. The sealing edge 122 can be formed by sewing the two sheets of material together and can be formed between two transverse edges of the marking panel 100, as shown in the figures, or alternatively, the sealing edge can be between two substantially parallel edges (not shown). In the latter embodiment, the sealing edge can form an elongated pocket along one or more edges of the marking panel, which can be used to house additional magnets or to reposition magnets according to the particular implementation (e.g., to align the magnets with portions of ferromagnetic material in a mounting structure or vehicle). The elongated body can additionally be partitioned into smaller pockets that, in some embodiments, each house an additional magnet. While increasing the weight of the marking panel, additional magnets can provide a stronger association between the marking panel and a ferromagnetic mounting structure/vehicle.

In some embodiments, a vehicle can be manufactured to include ferromagnetic material spaced apart at intervals and patterned to match the magnets of the marking panel, thereby affording a defined or specifically designed marking panel site on the vehicle.

In some embodiments, the pockets are sealed by a closure mechanism (e.g., hook and loop flap, button, press fit mechanism, zipper) so that the magnets are accessible and interchangeable. This can allow some measure of adaptability and customization of the marking panel so that stronger (or weaker) magnets or a greater (or fewer) number of magnets can be associated with the marking panel.

Figure 3:
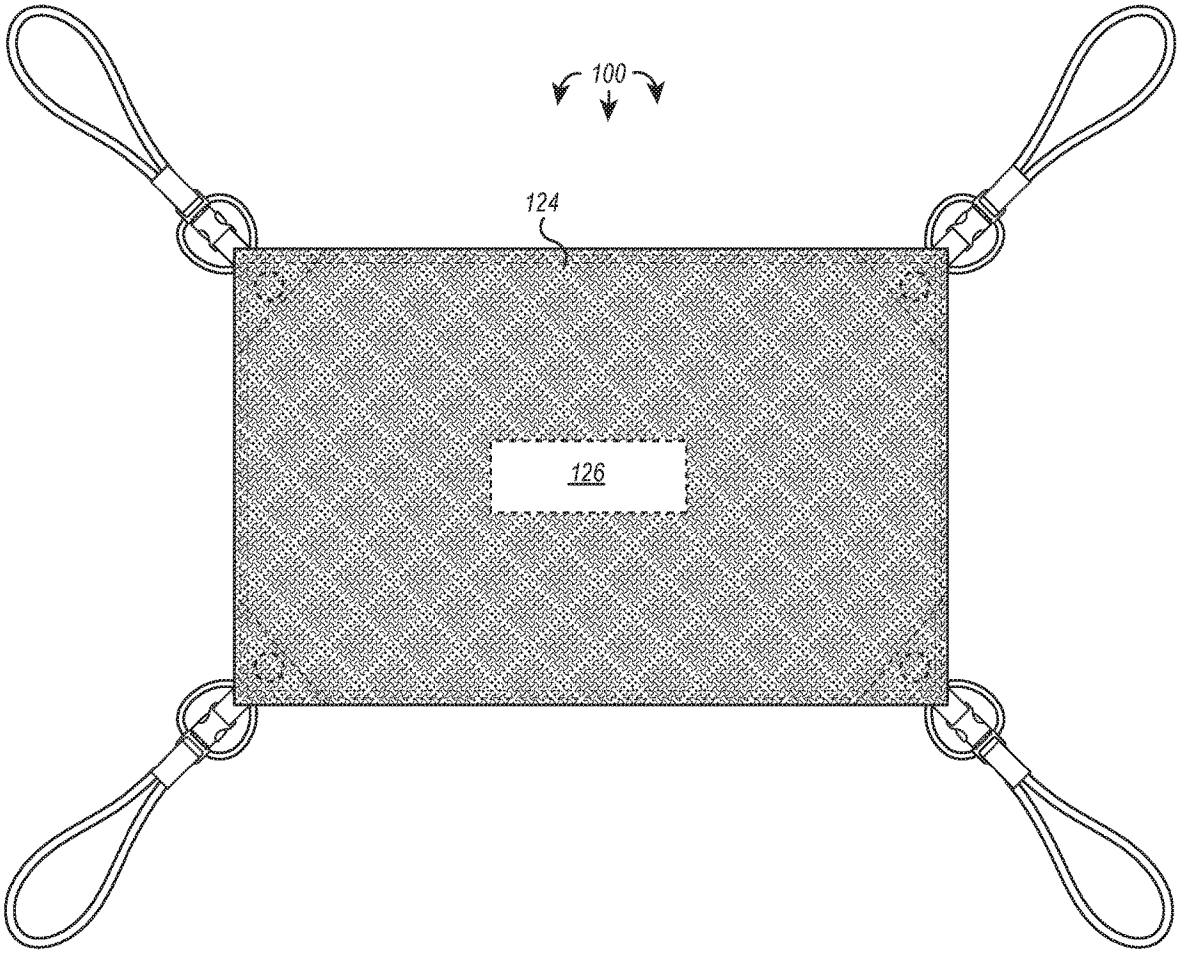
FIG. 3 illustrates a rear elevation view of the marking panel of FIG. 1.
Figure 4:
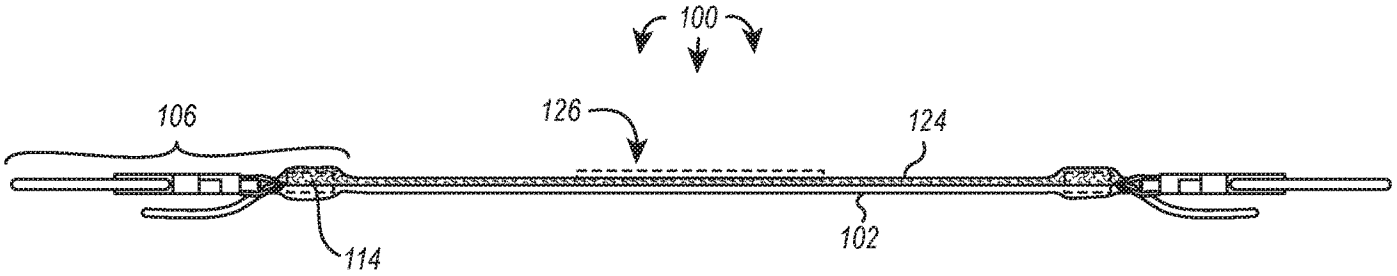
FIG. 4 illustrates a top plan view of the marking panel of FIG. 1.
Figure 5:
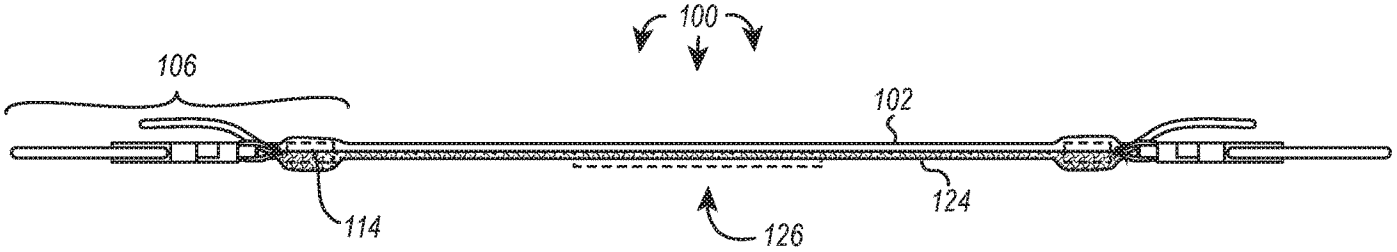
FIG. 5 illustrates a bottom plan view of the marking panel of FIG. 1.
Figure 6:
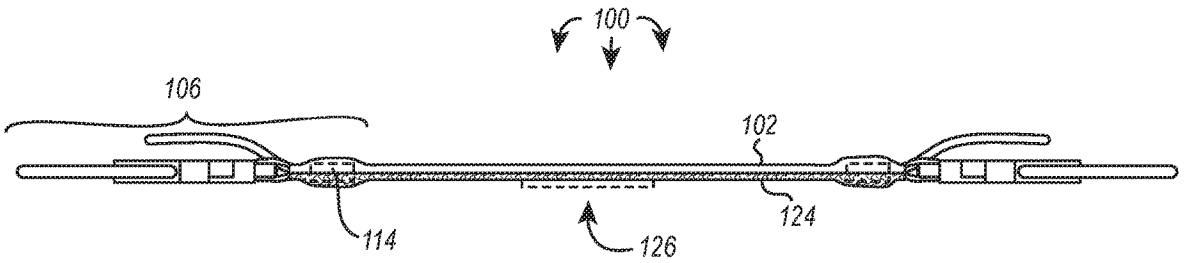
FIG. 6 illustrates a right side elevation view of the marking panel of FIG. 1.
Figure 7:
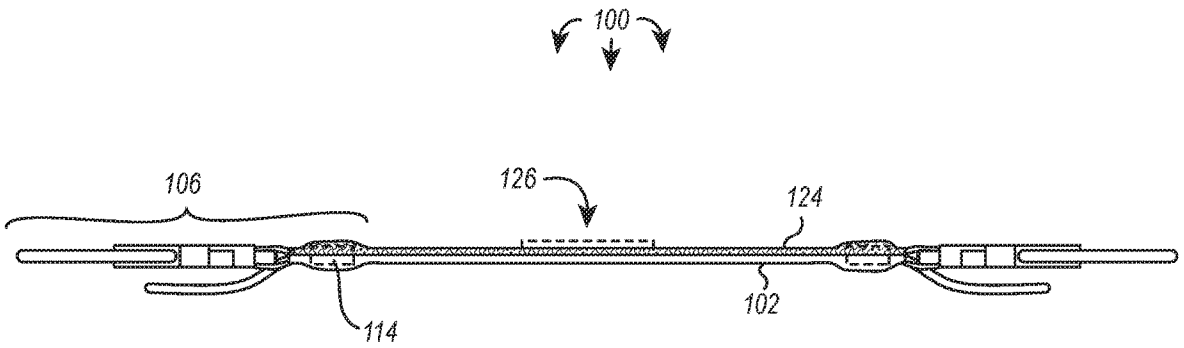
FIG. 7 illustrates a left side elevation view of the marking panel of FIG. 1.

Referring now to FIG. 3, illustrated is a rear view of the marking panel 100 of FIG. 1. As shown, the marking panel 100 can additionally include a rear surface 124. The rear surface can be a high-visibility color that is the same or a different high-visibility color as the front surface, or in some embodiments, it can be a non-high-visibility color or camouflage pattern.

The rear surface 124 can additionally include an optical enhancer attachment site 126 configured to receive an optical enhancer element to improve or expand the visibility of the marking panel 100. For example, the optical enhancer element can be an infrared reflective patch, luminous device (e.g., glow stick), or light-activated fluorescent patch that enhances the visibility of the marking panel, particularly in low light (i.e., the visible light spectrum) situations. The optical enhancer element can be a separate piece that is selectively associated with the attachment site 126. It can selectively associate by any means known in the art, including, for example, a hook and loop fastener, an adhesive, a magnet, or similar. In some embodiments, the optical enhancer attachment site 126 includes a patch of one portion of a hook and loop fastener (e.g., the loops) sewed or otherwise coupled to the rear surface 124, and the optical enhancer element has the complementary portion of the hook and loop fastener (e.g., the hooks) coupled to its body or component associated therewith.

In an exemplary operation of the marking panel 100 and optical enhancer element, the high-visibility front and/or rear surfaces 102, 124 of the marking panel 100 can be used to attract recognition in daylight (or other lighted) conditions. At twilight or following sunset, when the environmental light is insufficient to reflect off of the high-visibility colored surface, the marking panel 100 can be turned over to orient the optical enhancer attachment site 126 toward the desired direction for recognition by aerial (or other) support and/or rescue personnel. An optical enhancer element, such as an infrared reflective patch, can be secured to the optical enhancer attachment site 126 to continue utility of the marking panel 100 in the low-light or no-light situation. In embodiments where the optical enhancer element is an infrared reflective patch, the user can advantageously advertise their position without introducing a signal into the visible light spectrum. This can help to avoid notice by enemy combatants or other non-desirable party who lack appropriate specialized equipment to view the infrared reflective patch while beneficially enabling search parties and/or support crews to identify and track the marking panel. Additionally, in some embodiments, the optical enhancer element includes a flap or cover that can be selectively applied to the optical enhancer element. This can allow the optical enhancer element to remain attached to the marking panel while still providing the versatility of selective signaling.

Figure 8:
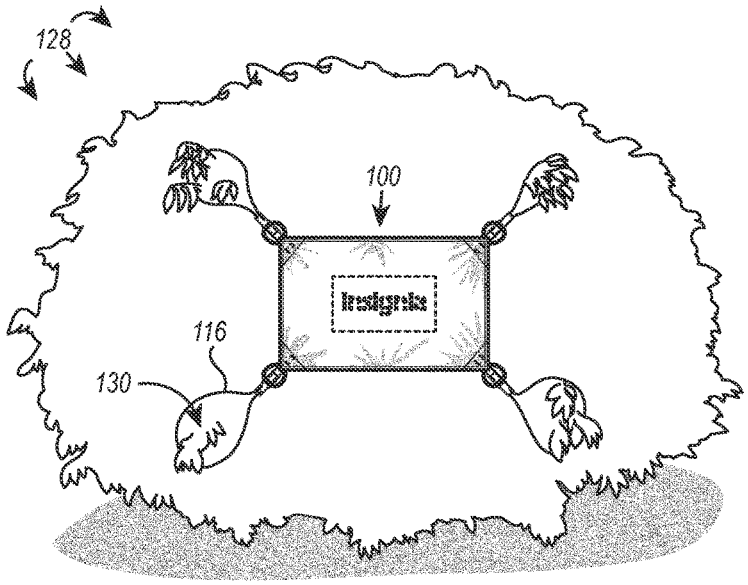
FIG. 8 illustrates an exemplary implementation of a disclosed marking panel, shown attached to a bush, in accordance with embodiments of the present disclosure.
Figure 9:
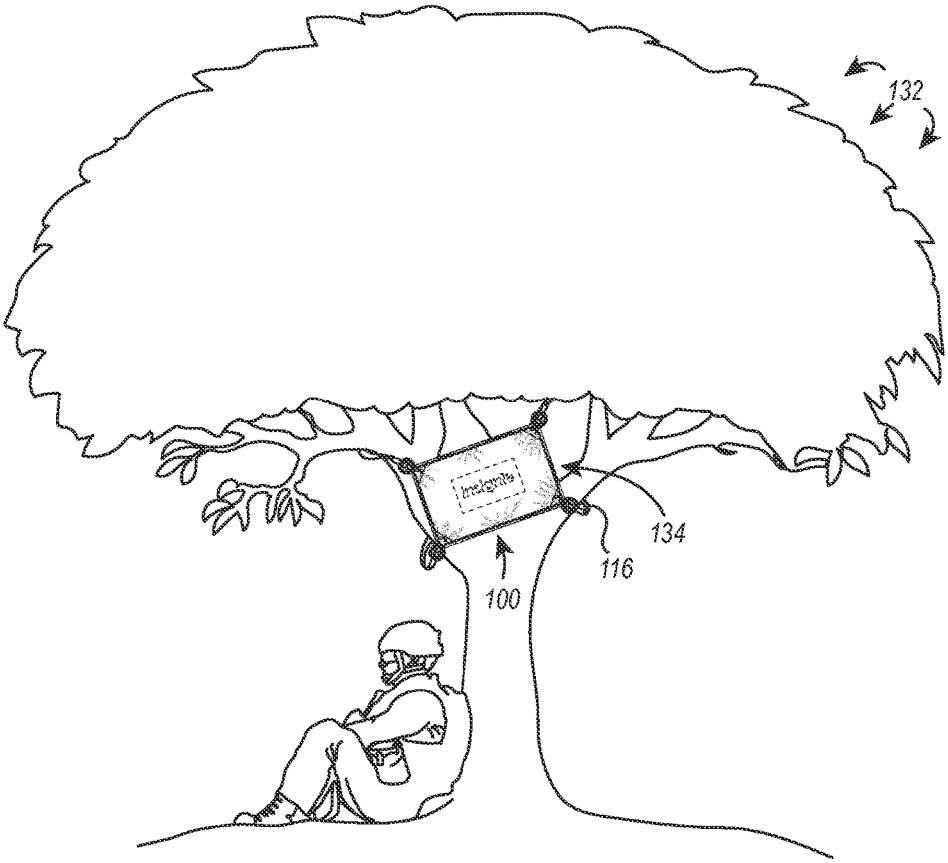
FIG. 9 illustrates another exemplary implementation of a disclosed marking panel, shown attached to a tree, in accordance with embodiments of the present disclosure.
Figure 10:
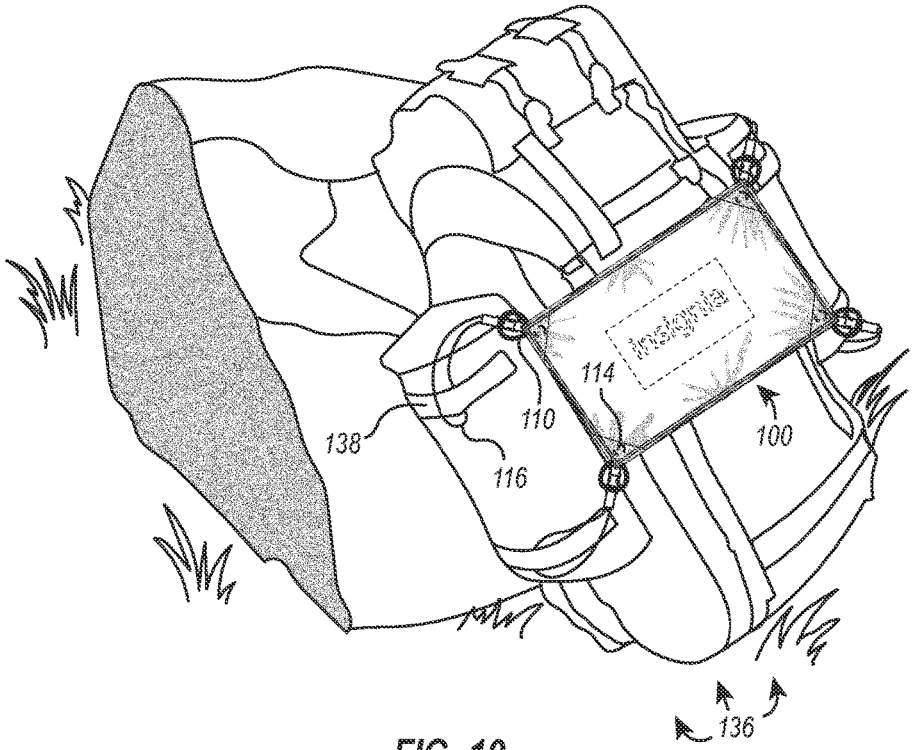
FIG. 10 illustrates yet another exemplary implementation of a disclosed marking panel, shown attached to a pack, in accordance with embodiments of the present disclosure.

Referring now to FIGS. 8-10, illustrated are various exemplary implementations of the marking panel 100 of FIGS. 1-7. As shown in FIG. 8, a marking panel 100 is illustrated as being attached to the top of a bush 128. The elastic loops 116 are stretched over and around a tuft 130 of branches and foliage, securing the marking panel 100 in position on the bush 128. As shown, the marking panel 100 is directed towards the sky so it can be identified from an aerial view. The marking panel 100 of FIG. 8 could alternatively be viewed as being attached to a side portion of a bush 128, again secured to the bush 128 by stretching elastic loops 116 over and around the tufts 130 of branches and foliage. In this imagined position, the marking panel 100 may still be seen from an aerial viewpoint but it may also be more easily seen by ground forces.

FIG. 9 illustrates another embodiment where the marking panel 100 is attached to an environmental object. In this case, the marking panel 100 is secured to branches of a tree 132. This can be done, for example, by forming a Lark's Head knot around a branch with the elastic loop 116 and reconnecting the elastic loop 116 to the marking panel 100, as described above.

As shown in FIG. 10, the marking panel 100 can be attached to a rucksack 136 or other piece of equipment using the elastic loops 116. The elastic loops can attach to straps 138 on the rucksack 136 by sliding the strap 138 through the elastic loops 116 (as shown). Alternatively, the elastic loops 116 can be tied to the rucksack. In one embodiment, the elastic loops 116 are tied to the rucksack 136 by forming a Lark's Head knot (or other knot) around the rucksack straps 138 and reconnecting the elastic loop 116 to the marking panel 100. In another embodiment, the elastic loops 116 are tied to the rucksack 138 by forming a Lark's Head knot (or other knot) around the rucksack straps 138 and the fixed loop 110, forming a tighter association between the rucksack 136 and the marking panel 100. Additionally, or alternatively, the marking panel 100 can be attached to the rucksack 136 by associating magnets 114 with ferromagnetic material on and/or in the rucksack 136.

Figure 11:
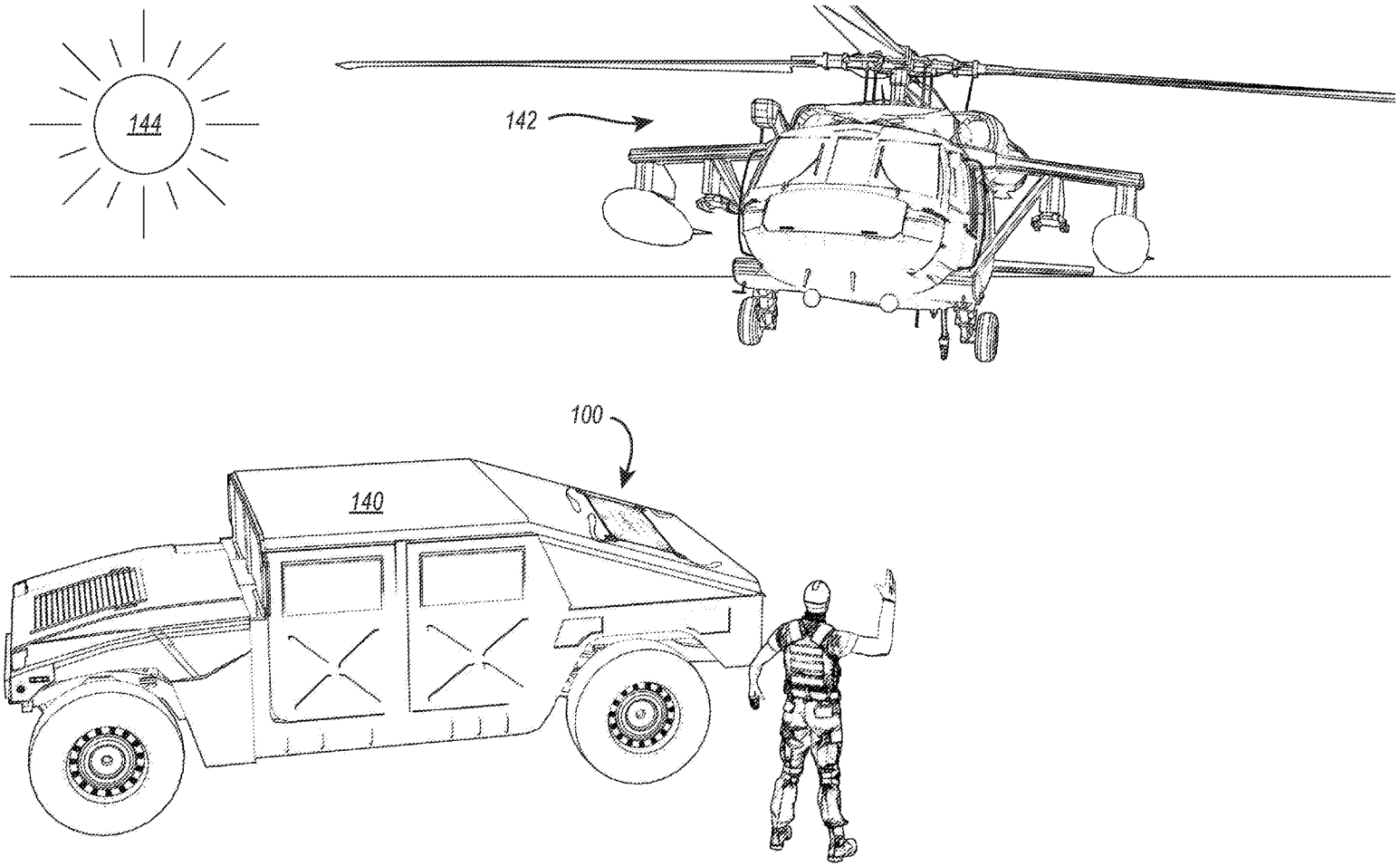
FIG. 11 illustrates still yet another exemplary implementation of a disclosed marking panel, shown attached to a vehicle, in accordance with embodiments of the present disclosure.

In some embodiments, the marking panel can be associated with a vehicle to identify and potentially differentiate the marked vehicle from other vehicles. This can be particularly advantageous in situations where a vehicle is acquired for extraction (or other purposes), and that vehicle lacks any formal markings to identify it, for example, from an aerial perspective. As shown in FIG. 11, the marking panel 100 can be magnetically associated with a vehicle (illustrated as Humvee 140) to allow a support helicopter 142 to identify and track the vehicle. As it is possible that the vehicle will be traveling while the marking panel 100 is attached, the marking panel 100 is configured to withstand the subsequent wind force applied against it and thereby remain attached to the vehicle.

The term "wind force," as used herein, is the amount of force, measured in Newtons, that wind traveling at a given rate exerts on an object. As used herein, the term "wind force" can relate the amount of force applied to a marking panel when attached to a moving vehicle or as received from a wind source, such as a helicopter downdraft, and can inform the required force exerted by the wind to overcome the magnetic force affixing the marking panel to the vehicle.

As a non-limiting example for illustrative purposes, wind force can be measured using Newton's second law of motion, which states that force is equal to mass times acceleration, or F=(m)*(a). The amount of wind force can therefore be calculated as the mass of the wind times the acceleration of the wind. The mass of air hitting the surface area of the marking panel then equals air density times the area of the marking panel affected by the wind. For simplicity, consider an 11 inch (27.94 cm) by 18 inch (45.72 cm) marking panel affected by a 55 mph (24.5872 m/s) wind at sea level. The average density of air at sea level is 1.229 $kg/m^3$. Accordingly, using the formula F=(m)*(a), $$F(\text{wind})=[(\text{area of affected marking panel})(\text{air density})]*[(\text{wind speed})].$$

If the marking panel is attached to a vehicle, either the long edge or the short edge will be affected by the wind force. When the wind is applied along the long edge (and conservatively assuming a 1-inch edge thickness), the marking panel experiences a wind force of:

$$F(\text{wind})=[(0.0254\ \text{m}*0.4572\ \text{m})(1.229\ \text{kg/m}^3)]*[(24.5872)]=8.6\ \text{N}.$$

When the wind is applied along the short edge (and again conservatively assuming a 1-inch edge thickness), the marking panel experiences a wind force of:

$$F(\text{wind})=[(0.0254\ \text{m}*0.2794\ \text{m})(1.229\ \text{kg/m}^3)]*[(24.5872)]=5.3\ \text{N}.$$

Thus, in the foregoing exemplary embodiment, for the marking panel to remain attached to a vehicle traveling at 55 mph (or equivalently experiencing a 55 mph wind), the magnets (e.g. rare-earth magnets) can each, or collectively, be configured to remain attached to the vehicle when a wind force less than or equal to 8.6 N is applied, preferably less than or equal to 10 N. In some embodiments, each magnet can be removed from an associated ferromagnetic material by exerting a pulling force greater than 2N, preferably greater than 5 N, or in some instances greater than 9 N. Magnets that individually, or collectively, have a pull force rating within the foregoing ranges are suitable, when used in the disclosed marking panel, for maintaining the position of the marking panel under opposing wind forces of at least 55 mph. Given the guiding principles outlined above, it should be appreciated that magnets with a weaker pull force rating can be used in situations where the marking panel may experience less wind force. Similarly, magnets with a stronger pull force rating can be used in situations where the marking panel may experience greater wind force.

Figure 12:
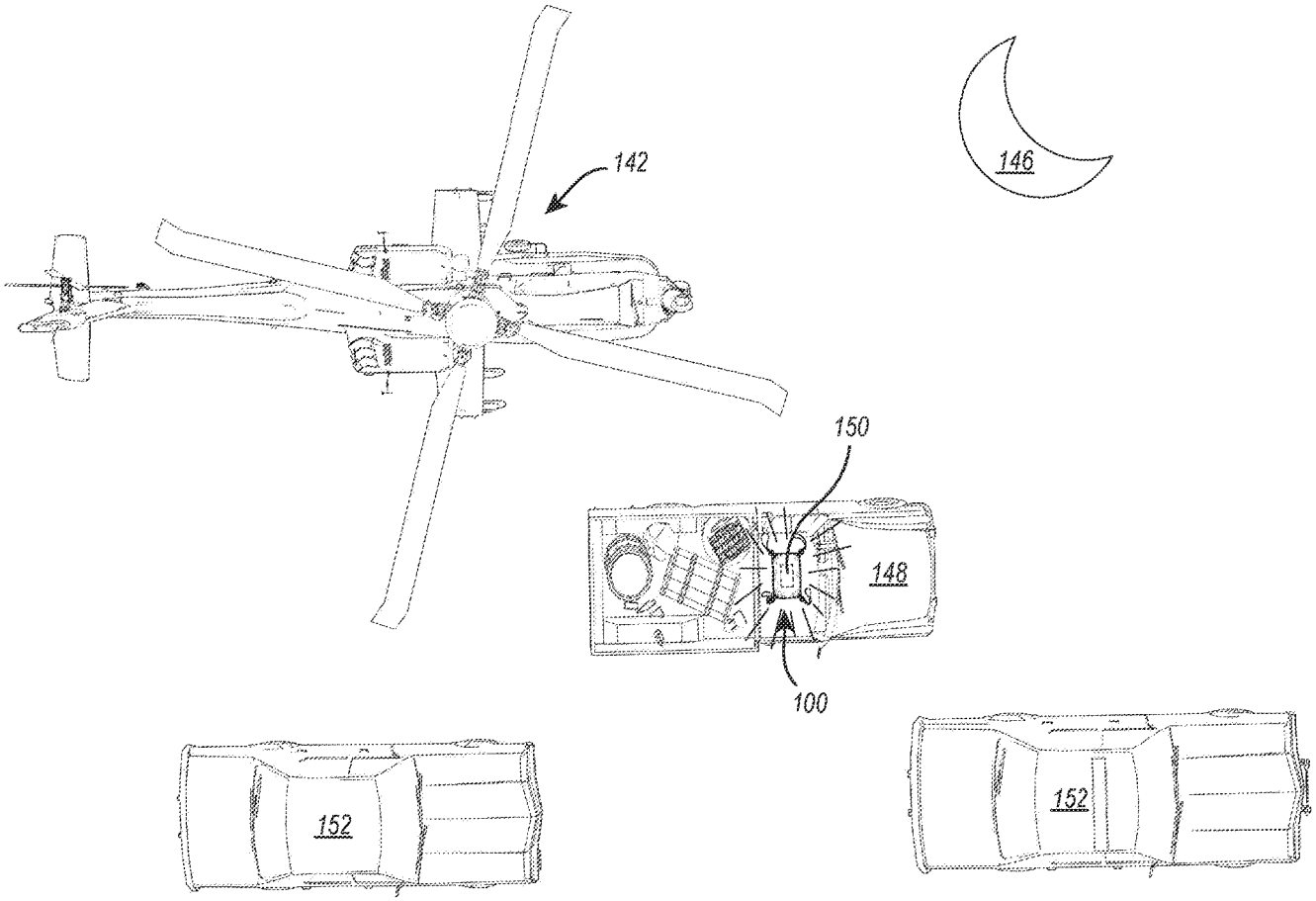
FIG. 12 illustrates still another exemplary implementation of a disclosed marking panel, shown attached to a vehicle, in accordance with embodiments of the present disclosure.

With continued reference to FIG. 11, the marking panel 100 is positioned on the Humvee 140 such that a surface having a high-visibility color is directed towards the support helicopter 142. This is advantageous in the daylight setting 144 illustrated in FIG. 11. However, in a nighttime or low-light setting 146 as illustrated in FIG. 12, the support helicopter 144 may have difficulties identifying and tracking a vehicle 148 using only the high-visibility color of the marking panel 100.

Instead, the marking panel 100 can be turned over to reveal an optical enhancer element 150 and again magnetically attached to the hood or roof of the vehicle 148. The support helicopter 142 can identify and track the vehicle 148 in the nighttime environment 146 by, for example, viewing the reflected infrared light off of the optical enhancer element 150. In this way, the support helicopter can differentiate the vehicle 148, which may be a temporarily acquired or specifically chosen civilian-style vehicle, from other similar looking vehicles 152. This can be advantageous if the support helicopter 142 (or other aerial support vehicle such as an unmanned aerial vehicle or jet) is providing tactical support or deploying ordinance around the vehicle 148.

In some embodiments, the marking panel 100 can be initially secured to a vehicle using the magnets 114 and subsequently reinforced by attaching the elastic loops 116 and/or fixed loops 110 to the vehicle.

Embodiments of the present disclosure can additionally include a stuff sack sized and shaped to receive and secure the marking panel in a compact form. In one embodiment, the stuff sack is a bag or large pocket with a flap or closure that can be secured after receiving the folded or stuffed marking panel. The closure or flap can include a closing mechanism, such as a hook and loop fastener, button, zipper, drawstring, or other closing mechanism know in the art to secure the marking panel within the stuff sack. It should be appreciated that the stuff sack provides an organized storage container for the marking panel when not in use and can additionally act to reduce the footprint of the marking panel in a pack, survival kit, or other form for later use.

Unless defined otherwise, all technical and scientific terms used herein have the same meaning as commonly understood by one of ordinary skill in the art to which the present disclosure pertains.

Various aspects of the present disclosure, including devices, systems, and methods may be illustrated with reference to one or more embodiments or implementations, which are exemplary in nature. As used herein, the term "exemplary" means "serving as an example, instance, or illustration," and should not necessarily be construed as preferred or advantageous over other embodiments disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," "involves," "contains," etc.), and similar terms as used herein, including within the claims, shall be inclusive and/or open-ended, shall have the same meaning as the word "comprising" and variants thereof (e.g., "comprise" and "comprises"), and do not exclude additional un-recited elements or method steps, illustratively.

Any headings used herein are for organizational purposes only and are not meant to be used to limit the scope of the description or the claims.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A marking panel, comprising:
- a first side;
- a second side transverse to the first side and intersecting the first side at a junction;
- a front surface at least partially defined by the first and second sides, the front surface comprising an insignia;
- a rear surface opposite the front surface and at least partially defined by the first and second sides, the rear surface comprising an optical enhancer attachment site; and
- a first multi-modal anchoring mechanism disposed proximate the junction of the first and second sides, the first multi-modal anchoring mechanism comprising:
  - a pocket;
  - a fixed loop; and
  - a selectively attachable loop.

2. The marking panel of claim 1, further comprising a rare-earth magnet secured within the pocket.

3. The marking panel of claim 1, wherein the selectively attachable loop further comprises a fixed portion associated with the junction and an attachment mechanism selectively coupling the fixed portion to a detachable elastic loop.

4. The marking panel of claim 3, wherein the attachment mechanism comprises a quick-release buckle, a carabiner and a corresponding anchor, or a spring snap hook and a corresponding ring.

5. The marking panel of claim 3, wherein one or both of the front surface or the rear surface comprise a high-visibility color.

6. The marking panel of claim 5, wherein the high-visibility color of the rear surface comprises a different high-visibility color than the front surface.

7. The marking panel of claim 5, wherein the high-visibility color is selected from the group consisting of blaze orange, chartreuse green, chartreuse yellow, or high-visibility tints thereof.

8. The marking panel of claim 5, wherein the optical enhancer attachment site comprises one portion of a hook and loop fastening system, the complementary portion of the hook and loop fastening system being associated with an infrared reflective patch selectively associated with the optical enhancer attachment site.

9. The marking panel of claim 1, wherein the insignia covers at least 25% of a surface area of the front surface.

10. The marking panel of claim 9, wherein the insignia covers at most 50% of the surface area of the front surface.

11. The marking panel of claim 10, wherein the insignia is positioned in the center of the front surface.

12. A marking panel, comprising:
- at least two corners, each corner defined by transverse sides of the marking panel;
- a front surface at least partially defined by the at least two corners, the front surface comprising an insignia;
- a rear surface opposite the front surface and at least partially defined by the at least two corners;
- at least two pockets, each pocket defined by the front and rear surfaces and at least partially bounded by a corner of the at least two corners;
- at least two multi-modal anchoring mechanisms, each disposed at least partially within a separate pocket of the at least two pockets, wherein each of the at least two multi-modal anchoring mechanisms comprise:
  - a magnet disposed within the separate pocket;
  - a fixed loop spanning the corner;
  - a fixed portion coupled to the separate pocket and having an attachment mechanism; and
  - an elastic loop selectively coupled to the attachment mechanism of the fixed portion via a complementary attachment mechanism.

13. The marking panel of claim 12, wherein the rear surface comprises an optical enhancer attachment site.

14. The marking panel of claim 13, wherein the optical enhancer attachment site comprises one portion of a hook and loop fastening system, the complementary portion of the hook and loop fastening system being associated with an infrared reflective patch selectively associated with the optical enhancer attachment site.

15. The marking panel of claim 12, wherein the attachment mechanism comprises a quick-release buckle, a carabiner and a corresponding anchor, or a spring snap hook and a corresponding ring.

16. The marking panel of claim 15, wherein the insignia covers at least 25% of a surface area of the front surface and is positioned in the center of the front surface.

17. A system for identifying field personnel, comprising:
- a marking panel, comprising:
  - a first sheet of material comprising an insignia;
  - a second sheet of material coupled to the first sheet of material such that the first sheet comprises a front surface of the marking panel and the second sheet comprises a rear surface of the marking panel, the second sheet comprising an optical enhancer attachment site;
  - at least four pockets formed between the first and second sheets, each pocket formed at a corresponding corner of the marking panel and comprising a multi-modal anchoring mechanism, each of the multi-modal anchoring mechanisms comprising:
    - a rare-earth magnet disposed within the each pocket;

a fixed loop spanning the corresponding corner;

a fixed portion coupled to the each pocket and having an attachment mechanism; and an elastic loop selectively coupled to the attachment mechanism of the fixed portion via a complementary attachment mechanism; and a stuff sack sized and shaped to receive and secure the marking panel in a compact form.

18. The system of claim 17, wherein the stuff sack comprises a pocket for receiving the marking panel in the compact form and a fold-over flap for closing an opening of the stuff sack, the fold-over flap securing the marking panel within the stuff sack by selectively engaging a hook and loop fastener.

19. The system of claim 17, wherein the marking panel is configured to attach to a vehicle via the rare-earth magnet disposed within the each pocket and remain attached to the vehicle in response to a wind speed of 55 mph or a wind force of less than or equal to 5 N.

20. The system of claim 17, wherein the attachment mechanism comprises a quick-release buckle, a carabiner and a corresponding anchor, or a spring snap hook and a corresponding ring.

* * * * *